US005467986A

United States Patent [19]

Weiland

[11] Patent Number: 5,467,986

[45] Date of Patent: Nov. 21, 1995

[54] PNEUMATICALLY PROJECTED BALL TABLE GAME

[76] Inventor: Kenneth E. Weiland, P.O. Box 706, Enosburg Falls, Vt. 05450

[21] Appl. No.: 118,519

[22] Filed: Sep. 9, 1993

[51] Int. Cl.[6] ..... A63B 71/00

[52] U.S. Cl. ..... 273/129 AP

[58] Field of Search ..... 273/30, 129 AP

[56] References Cited

U.S. PATENT DOCUMENTS

| | | | |
|---|---|---|---|
| 1,995,543 | 3/1935 | Kaser | 273/30 |
| 2,313,710 | 3/1943 | White | 273/30 |
| 2,447,743 | 8/1948 | Dieter | 273/30 |
| 2,688,484 | 9/1954 | Garber | 273/30 |
| 3,819,182 | 6/1974 | Lersch | 273/30 |
| 3,823,938 | 7/1974 | Unno | 273/30 |
| 4,030,734 | 1/1977 | Castellucci | 273/30 |
| 5,020,799 | 6/1991 | Chang | 273/30 |

FOREIGN PATENT DOCUMENTS

| | | | |
|---|---|---|---|
| 1478055 | 3/1965 | Germany | 273/30 |
| 203516 | 9/1923 | United Kingdom | 273/30 |

*Primary Examiner*—Theatrice Brown
*Attorney, Agent, or Firm*—Michael I. Kroll

[57] ABSTRACT

A unique skill-action table game is provided, which consists of a rectangular shaped game board defining a court having a center line which divides the court into two playing areas, with two end goal lines and two side lines. A small lightweight hollow ball is also utilized, when the game board is elevated at least two players can each stand behind one of the end goal lines and try to blow with their mouth the small lightweight hollow ball over the opposite end goal line, to receive a point each time during the play of the game.

11 Claims, 2 Drawing Sheets

PNEUMATICALLY PROJECTED BALL TABLE GAME

BACKGROUND OF THE INVENTION

1. Field of the Invention

The instant invention relates generally to table tennis and more specifically it relates to a unique skill-action table game.

2. Description of the Prior Art

Numerous table tennis equipment have been provided in prior art that are utilized in playing the game, which is similar to lawn tennis, played on a table with wooden paddles and a small celluloid ball. While these units may be suitable for the particular purpose to which they address, they would not be as suitable for the purposes of the present invention as heretofore described.

SUMMARY OF THE INVENTION

A primary object of the present invention is to provide a unique skill-action table game that will overcome the shortcomings of the prior art devices.

Another object is to provide a unique skill-action table game in which each player standing at opposite ends must shoot by blowing a lightweight ball past an opponent over a goal line without going outside the playing field, which is the opponent's half of the game board to score points in playing the game.

An additional object is to provide a unique skill-action table game in which each player will receive therapeutic value of increased lung capacity and athletic coordination through continued playing of the game.

A further object is to provide a unique skill-action table game that is simple and easy to use.

A still further object is to provide a unique skill-action table game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
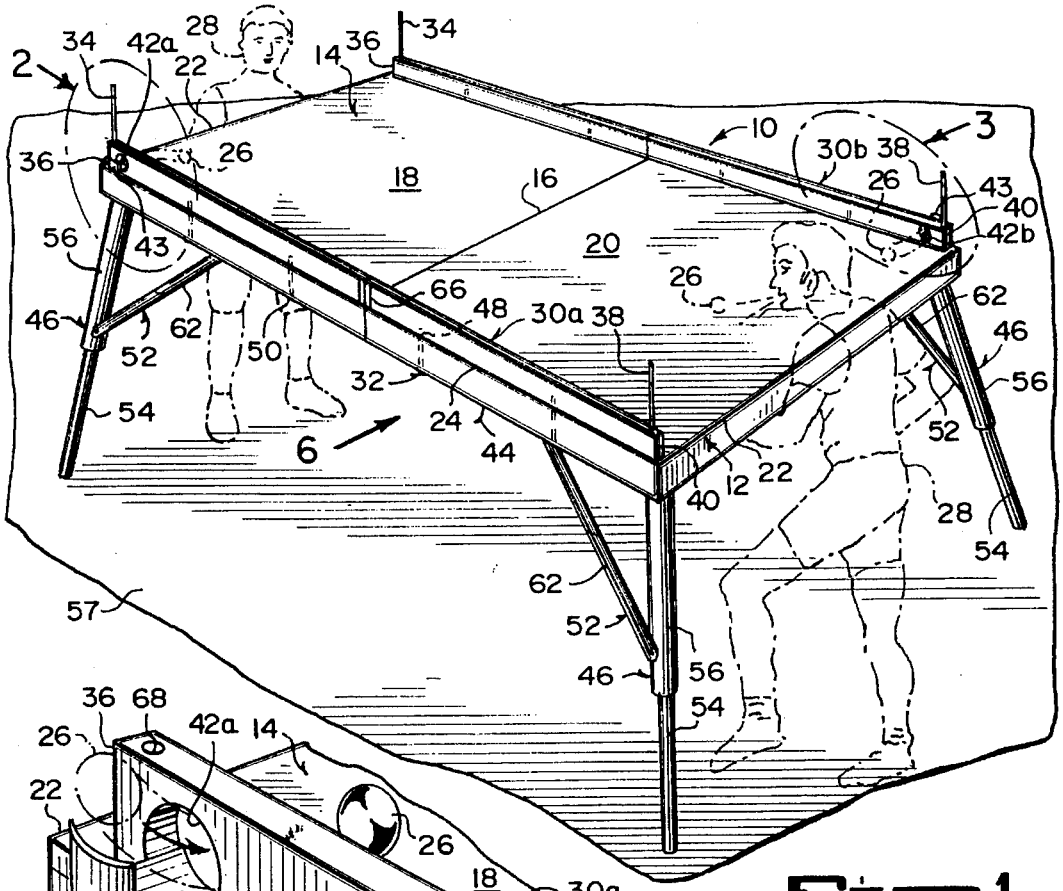
FIG. 1 is a perspective view of the instant invention.

Turning now descriptively to the drawings, in which similar reference characters denote similar elements throughout the several views, FIGS. 1 through 6 illustrates a unique skill-action table game 10, which consists of a rectangular shaped game board 12 defining a court 14 having a center line 16, which divides the court 14 into two playing areas 18, 20 with two end goal lines 22 and two side lines 24. A small lightweight hollow ball 26 is also utilized. When the game board 12 is elevated at least two players 28 can each stand behind one of the end goal lines 22 and try to blow with their mouth the small lightweight hollow ball 26 over the opposite end goal line 22, to receive a point each time during the play of the game.

The unique skill-action table game 10 further includes a pair of side rails 30*a*, 30*b*. Fasteners 32 are for attaching each side rail 30*a*, 30*b* over one of the side lines 24 on the game board 12, so as to deflect the small lightweight hollow ball 26 and prevent it from falling over the side lines 24, during the play of the game.

A first pair of goal post 34 are mounted upright on the same first ends 36 of the first and second side rails 30*a*, 30*b*, so that the first pair of goal posts 34 will be first opposite from each other at one end goal line 22 to represent the first player 28. A second pair of goal post 38 are mounted upright on the same second ends 40 of the first and second side rails 30*a*, 30*b*, so that the second pair of goal post 38 will be opposite from each other at the other end goal line 22 to represent the second player 28.

The first side rail 30*a* has a side opening 42*a* therethrough at the first end 36. The second side rail 30*b* has a side opening 42*b* therethrough at the second end 40, so that the side openings 42*a*, 42*b* are diagonally opposite from each other. A pair of L-shaped servers 43 are provided, with each inserted into one side opening 42*a*, 42*b*, so that each player 28 can insert the small lightweight hollow ball 26 through their respective side opening 42*a*, 42*b* in the side rail 30*a*, 30*b* to make a serve during the play of the game.

A table frame 44 is secured to the underside of the game board 12. Four legs 46 are each located in one cover of the table frame 44, so that the legs 46 will elevate the game board 12 and the table frame 44.

Figure 2:
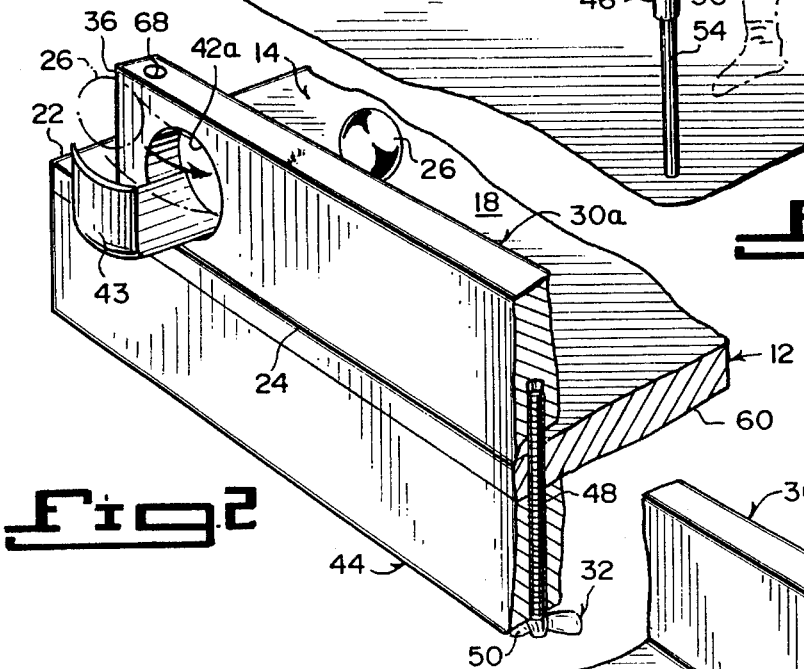
FIG. 2 is an enlarged perspective view of a portion thereof, as indicated by arrow 2 in FIG. 1.
Figure 3:
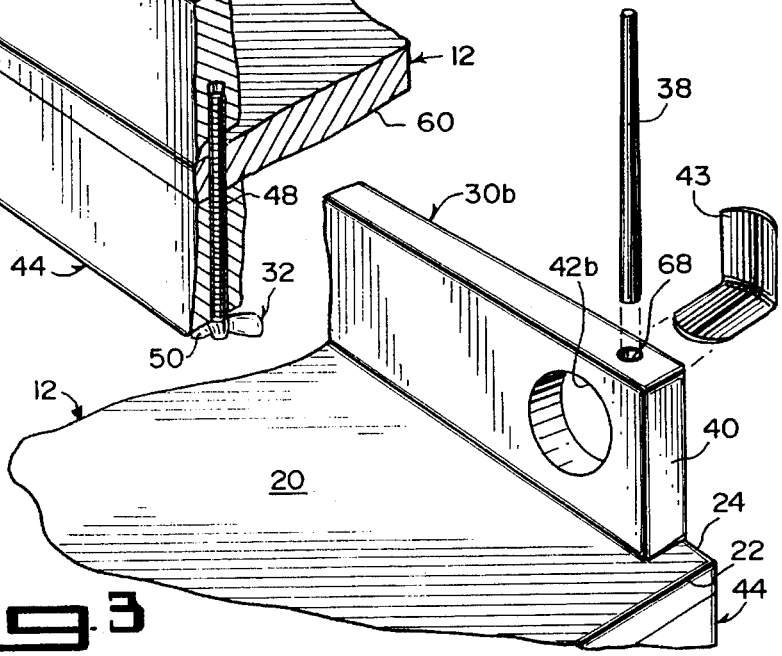
FIG. 3 is an enlarged perspective view of a portion thereof as indicated by arrow 3 in FIG. 1.
Figure 4:
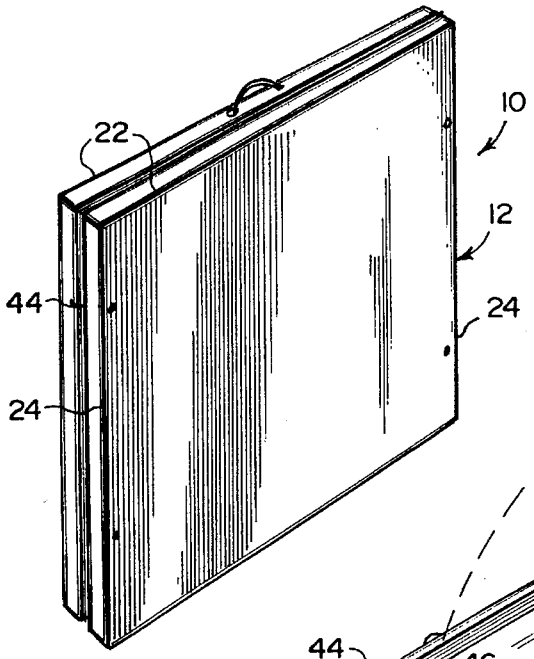
FIG. 4 is a perspective view of the instant invention fully closed, ready for transport or storage.
Figure 5:
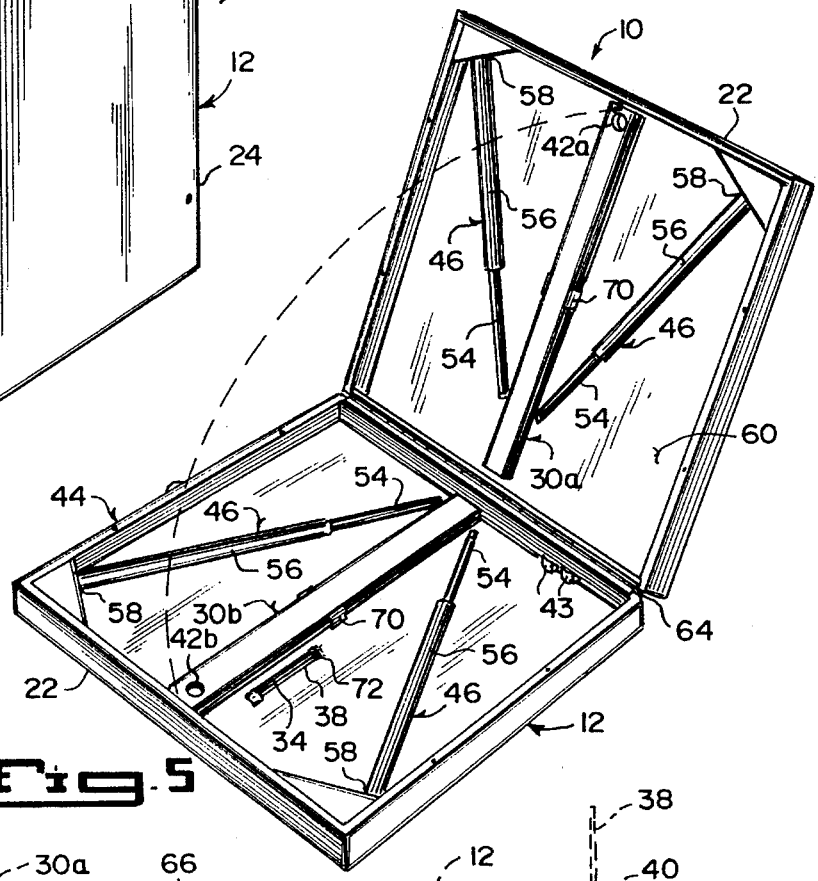
FIG. 5 is a perspective view of the instant invention partially opened.
Figure 6:
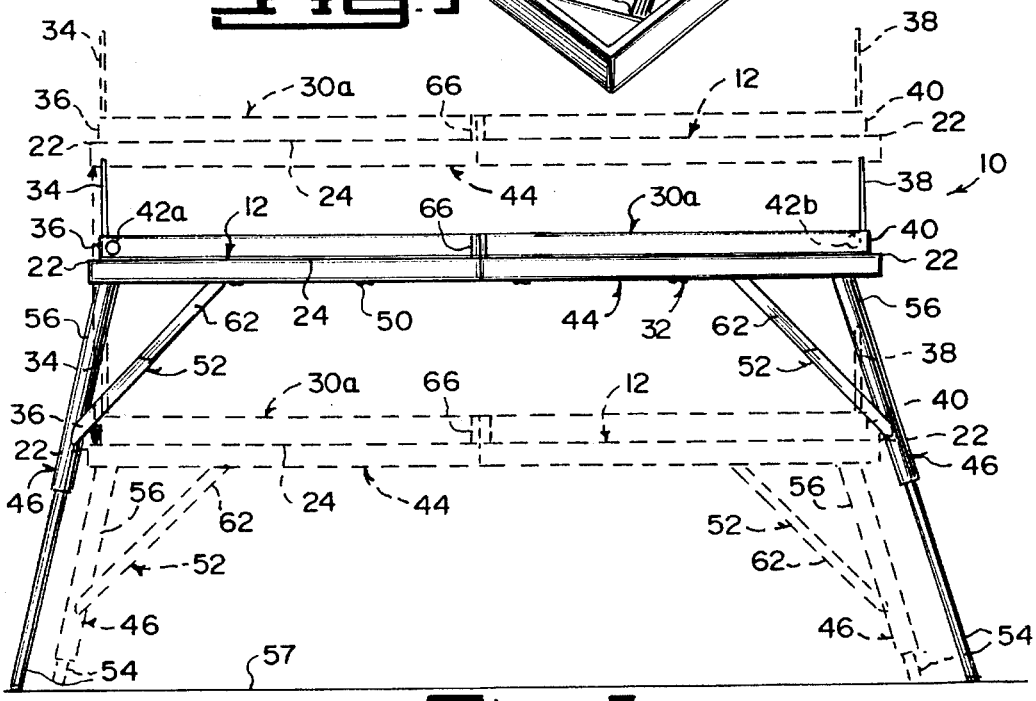
FIG. 6 is an elevational view taken in direction of arrow 6 in FIG. 1 showing height adjustment thereof.

Each side rail attaching fastener 32, as best seen in FIG. 2, includes a plurality of threaded rods 48, each extending upwardly in spaced apart locations through the table frame 44, the side line 24 of the game board 12 and into a bottom portion of the side rail 30*a*, 30*b*. A plurality of wing nuts 50 are also provided, with each threaded onto a lower distal end of each threaded rod 48, so as to secure the respective side rail 30*a*, 30*b* to the game board 12.

Four cross braces 52 are provided, with each extending at an angle between each leg 46 and the table frame 44 to stabilize each leg 46. Each leg 46 is telescopic having a lower segment 54, which can slide into an upper segment 56, so that the game board 12 and the table frame 44 can be height adjustable with respect to the floor 58. Each leg 46 is hinged at 58 in each corner of the table frame 44, so that each leg 46 is collapsible to the underside 60 of the game board 12.

Each cross brace 52 is a drop rail lock 62. When each leg 46 is collapsed, the respective drop rail lock 62 can fold up to the underside 60 of the board game 12.

The table frame 44 and the game board 12 are split into two halves along the center line 16. A continuous hinge 64 (see FIG. 5), is located between the split two halves of the table frame 44. The table frame 44 with the game board 12 can be folded in half for storage after the side rails 30*a*, 30*b* are removed therefrom.

Each side rail 30*a*, 30*b* is split into two halves between the ends 36, 40 thereof. A hinge 66 is located between the split two halves of each side rail 30*a*, 30*b*. When each side rail 30*a*, 30*b* is detached from the game board 12, it can be folded in half for storage. Each side rail 30*a*, 30*b* further has a pair of top apertures 68, each located at opposite ends 36, 40, so that each goal post 34, 38 can be inserted and removed from each top aperture 68.

A pair of clamps 70 are included, with each affixed to the underside 60 of each half of the game board 12, to retain each folded side rail 30*a*, 30*b* thereto. A retainer 72 is affixed to the underside 60 of one half of the game board 12, to hold the goal posts 34, 38 thereto.

RULES AND GAMESMANSHIP

1. The table game can be played by two (singles) or four (doubles) players.
2. You volley for serve as you would in Volleyball. Winner of the volley serves first.
3. Two differently colored balls are used. This makes it easier to score. Like Volleyball, you only score a point on your serve. First player to get eleven wins. The winner must win by two points.
4. Service is always done through the Rail Servers located at each end. A ball dropped before going through the Server is not a fault. A ball missed on service (falls off the server's goal line end) is a fault.
5. Each player tries to blow or shoot the ball past his/her opponent(s). Obviously the other player tries to shoot it back. Blocking a shot with your face, arms, shoulders is quite legal. Anything but hands.
6. The ball must land, bounce or touch in the opponent's side of the court: that is, all that space within his/her half of the game board and between the Goal Posts. Just like table tennis.
7. Blowers are disqualified for spitting, slobbering, or expelling any gross bodily fluids on the ball or the game board. Catching the ball in your mouth and shooting it back is also forbidden.
8. As state before, the first player to get eleven wins the game. For standard play best of five games is set champion. In tournament play, a set is seven games.

In time you will find that a deep repertoire of shots are necessary for a competitive table game.

| | |
|---|---|
| Bank | Sharp bursting blow of a side rail. A double-bank is exceptionally effective because it catches your opponent leaning. |
| Corner | The side rails are purposefully one inch shorter than the game board. This gap is crucial for a power corner shooter. |
| Chip | Looks just like it sounds. If you catch the ball low and just at the edge of the game board, you can lob it into the deep side of the court. |
| Slam-Blow | This is what happens if your opponent catches a lob just right, and chucks it back in your face. |
| Turbo | This is a term for anything traveling at super human speed. It just happens, and you don't know why. Golfers refer to this divine act as Dead-Solid-Perfect. |
| Scud | These shots launch unexplainably into hyperspace. Can be the product of too much lip balm, or bad gas. |
| Lag | This is a strategic shot that stops short of your opponent's back goal line. You do this when you're blown out and just need to catch your breath. |
| Breaker | This is a shot with unintentional sound effects. For this reason players are cautioned about eating bean burritos prior to playing the table game. Breakers are great ways to make your opponent laugh, which is totally legal and very effective strategy. |
| Table Adjustment | The height of the game board should be no higher than the Adam's apple of the shorter player. In Sanctioned Tournament Play, platforms are built up for the shorter player. |

LIST OF REFERENCE NUMBERS

| | |
|---|---|
| 10 | unique skill-action table game |
| 12 | game board |
| 14 | court on 12 |
| 16 | center line of 14 |
| 18 | playing area of 14 |
| 20 | playing area of 14 |
| 22 | end goal line of 14 |
| 24 | side line of 14 |
| 26 | small lightweight hollow ball |
| 28 | player |
| 30a | first side rail |
| 30b | second side rail |
| 32 | fastener |
| 34 | first goal post |
| 36 | first end of 30a, 30b |
| 38 | second goal post |
| 40 | second end of 30a, 30b |
| 42a | side opening in 30a |
| 42b | side opening in 30b |
| 43 | server |
| 44 | table frame |
| 46 | leg |
| 48 | threaded rod |
| 50 | wing nut |
| 52 | cross brace |
| 54 | lower segment of 46 |
| 56 | upper segment of 46 |
| 57 | floor |
| 58 | hinge on 46 |
| 60 | underside of 12 |
| 62 | drop rail lock for 52 |
| 64 | continuous hinge in 44 |
| 66 | hinge in 30a, 30b |
| 68 | top aperture in 30a, 30b |
| 70 | clamp |
| 72 | retainer |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A game table apparatus comprising:

a) a table frame containing four legs, each said leg located in one corner of said table frame, so that said table frame is elevated;

b) a rectangular shaped game board secured to the top of said table frame, defining a court having a center line which divides the court into two playing areas with two end goal lines and two side lines;

c) a small lightweight hollow ball, whereby when said game board is elevated, at least two players can each stand behind one of the end goal lines and try to blow with their mouth, said small lightweight hollow ball over the opposite end goal line to receive a point each time during the play of the game;

d) a pair of side rails, each of said side rails being attached to one of said side lines, respectively, said first side rail having a side opening therethrough at said first end, said second side rail having a side opening therethrough at the second end, so that said side openings are diagonally opposite from each other, and a pair of L-shaped servers, each inserted into one said side opening, so that each player can insert said small lightweight hollow ball through their respective side opening in said side rail, to make a serve during the play of the game;

e) means for attaching each said side rail over one of the side lines on said game board, so as to deflect said small lightweight hollow ball and prevent it from falling over the side lines during the play of the game;

f) a first pair of goal posts, located opposite and representing said first player, mounted upright on the same first ends of said first and second side rails, so that said first pair of goal posts will be opposite from each other at one end goal line to represent the first player; and g) a second pair of goal posts, located opposite and representing said second player, mounted upright on the same second ends of said first and second side rails, so that said second pair of goal posts will be opposite from each other at the other end goal line to represent the second player.

2. A game table apparatus as recited in claim 1, wherein each said side rail attaching means includes:

a) a plurality of threaded rods, each extending upwardly in spaced apart locations through said table frame, the side line of said game board and into a bottom portion of said side rail; and b) a plurality of wing nuts, each threaded onto a lower distal end of each said threaded rod, so as to secure said respective side rail to said game board.

3. A game table apparatus as recited in claim 2, further including four cross braces, each extending at an angle between each said leg and said table frame to stabilize each said leg.

4. A game table apparatus as recited in claim 3, wherein each said leg is telescopic having a lower segment which can slide into an upper segment, so that said game board and said table frame can be height adjustable with respect to the floor.

5. A game table apparatus as recited in claim 4, wherein each said leg is hinged at each corner of said table frame, so that each said leg is collapsible to the underside of said game board.

6. A game table apparatus as recited in claim 5, wherein each said cross brace is a drop rail lock, so that when each said leg is collapsed, said respective drop rail lock can fold up to the underside of said board game.

7. A game table apparatus as recited in claim 6, further including:

a) said table frame and said game board are split into two halves along the center line; and b) a continuous hinge located between the split two halves of said table frame, so that said table frame with said game board can be folded in half for storage after said side rails are removed therefrom.

8. A game table apparatus as recited in claim 7, further including:

a) each said side rail is split into two halves between the ends thereof; and b) a hinge located between the split two halves of each said side rail, so that when each said side rail is detached from said game board it can be folded in half for storage.

9. A game table apparatus as recited in claim 8, wherein each said side rail further having a pair of top apertures, each located at opposite ends, so that each said goal post can be inserted and removed from each said top aperture.

10. A game table apparatus as recited in claim 9, further including a pair of clamps, each affixed to the underside of each half of said game board to retain each said folded side rail thereto.

11. A game table apparatus as recited in claim 10, further including a retainer affixed to the underside of one half of said game board to hold said goal posts thereto.

* * * * *